United States Patent [19]

Hickam et al.

[11] Patent Number: 4,635,468

[45] Date of Patent: Jan. 13, 1987

[54] GAS MONITORING METHOD AND DEVICE

[75] Inventors: William M. Hickam, Churchill Boro; Warren E. Snider, Elizabeth Township, Allegheny County, both of Pa.

[73] Assignee: Westinghouse Electric Corp., Pittsburgh, Pa.

[21] Appl. No.: 743,340

[22] Filed: Jun. 10, 1985

[51] Int. Cl.[4] ..... G01N 31/00

[52] U.S. Cl. ..... 73/19; 73/861.05; 204/1 T; 376/250

[58] Field of Search ..... 73/19, 40, 40.5 R, 40.7, 73/861.05, 861.07; 204/1 Y, 1 T, 406, 407, 404, 427; 376/216, 250, 256

[56] References Cited

U.S. PATENT DOCUMENTS

| | | | |
|---|---|---|---|
| 3,303,699 | 2/1967 | Scott | 73/861.05 |
| 3,347,767 | 10/1967 | Hickam | 204/410 |
| 3,400,054 | 9/1968 | Ruka et al. | 204/1 T |
| 3,435,660 | 4/1969 | Sternberg | 73/23.1 |
| 3,546,086 | 12/1970 | Sayles | 204/408 |
| 3,616,408 | 10/1971 | Hickam | 204/410 |
| 3,839,910 | 10/1974 | Fitch | 73/861.05 |
| 3,881,351 | 5/1975 | Prachar | 73/861.04 |
| 3,928,161 | 12/1975 | McIntyre et al. | 204/1 T |
| 4,121,455 | 10/1978 | Haslett et al. | 73/861.04 |
| 4,167,870 | 9/1979 | Haas | 73/861.05 |
| 4,170,770 | 10/1979 | Ichinose et al. | 340/634 |
| 4,178,919 | 12/1979 | Hall | 73/861.07 |
| 4,231,733 | 10/1980 | Hickam et al. | 204/426 |
| 4,341,077 | 7/1982 | Blair et al. | 73/3 |
| 4,427,620 | 1/1984 | Cook | 376/216 |
| 4,537,661 | 8/1985 | Lee et al. | 204/1 T |

OTHER PUBLICATIONS

Power, Apr. 1985, p. 127, article entitled "Iron Liquid Chromatograph Automates Steam and Water Analysis", McGraw Hill.

*Primary Examiner*—Stephen A. Kreitman

[57] ABSTRACT

A method for monitoring air inleakage and oxygen content in a steam system, including the steps of: monitoring air flowing in the exhaust of a condenser; determining the total gas flow rate and oxygen content thereof; injecting a pulse of oxygen into the exhaust and measuring the transit time to the monitoring location; determining actual air inleakage rates, independent of or along with the oxygen content thereof; comparing the actual air inleakage and oxygen rates with predetermined rates; and, if the actual rates are increasing relative to the predetermined rates, isolating and eliminating the air inleakage and introducing more oxygen scavenger or, if the actual rates are decreasing relative to the predetermined rates, introducing less oxygen scavenger. The related device includes a conventional, high temperature, oxygen-solid, electrolyte cell sensor for monitoring the total gas flow rate and oxygen content in the exhaust, and an oxygen pulse injector located upstream of the oxygen sensor for introducing a pulse of oxygen into the exhaust. The transit time of the oxygen from injection to the monitoring location is measured by a timing device and recorder. The air inleakage rates, independent of or along with the oxygen content thereof, are then measured. The feedback from these rates is then used to control the amount of air inleakage and oxygen content in the steam system.

7 Claims, 5 Drawing Figures

GAS MONITORING METHOD AND DEVICE

BACKGROUND OF THE INVENTION

This invention relates to gas monitoring and, more particularly, to a method and device for continuously monitoring air inleakage and the oxygen content thereof in a steam system having a condenser exhausting to the atmosphere and, based on the data obtained, controlling the air inleakage and the oxygen content in the steam system.

DESCRIPTION OF THE PRIOR ART

The gas monitoring method and device of the present invention is intended to be used in any type of steam system employing a condenser exhausting to the atmosphere. However, the present invention is particularly appropriate for use in a nuclear or fossil-fueled, steam generating, power plant. Accordingly, the conventional gas monitoring method and device used in such power plants will be discussed herein.

FIG. 1 shows a steam system in the form of a typical nuclear, or fossil-fueled, steam generating, power plant 10. Such a power plant 10 is described in commonly owned U.S. Pat. No. 4,427,620, issued to COOK. The power plant 10 generally includes a nuclear reactor or fossil fuel furnace 12, steam generators 14 and 16, a common steam header 18, turbines 20, an electrical generator 22, condensers 24, heaters 26, a condensate pump 28 and coolants pumps 30 and 32.

During operation of the power plant 10, steam is produced in the steam generators 14 and 16 and is supplied to the common steam header 18. The steam is then used to operate the turbines 20 and the generator 22 connected thereto. The steam is then routed to the condensers 24, where it is condensed into water. The water is then passed through the heaters 26 and is returned to the steam generators 14 and 16 via the condensate pump 28 to begin the cycle over again.

Stable gaseous impurities are also present in the condensers 24 after the water forms. These impurities are exhausted to the atmosphere through an exhaust system 36 connected to the condensers 24.

A major cause of corrosion of the above-listed components which contain iron is oxygen entering the power plant via "air inleakage," particularly at the turbines 20 and condensers 24. The term "air inleakage" means air entering the power plant 10 either in a gaseous state or as air dissolved in the feed water introduced to satisfy the water requirements of the power plant 10.

Air inleakage in the gaseous state consists of approximately 78% nitrogen, 21% oxygen and 1% argon. As such, depending upon how much, if any, air inleakage in the gaseous state there is, the oxygen content in the exhaust system 36 usually ranges from 0%–21%. On the other hand, when air inleakage is in the form of air dissolved in the feed water, the oxygen content thereof is enriched as a result of a higher oxygen solubility than nitrogen. Accordingly, it is also possible to have more than 21% oxygen content in air inleakage and in the exhaust system 36.

Metallic surfaces and organics within the power plant 10 scavenge by reaction to some extent the oxygen present in the steam system. However, in order to most effectively reduce the corrosion resulting from the oxygen entering via air inleakage, oxygen reactive chemical scavengers must be intentionally introduced into the power plant 10. These oxygen scavengers compete with the iron containing components of the power plant 10 for the oxygen present therein.

For example, as shown in FIG. 1, the oxygen scavenger known as hydrazine is introduced from a conventional hydrazine source 54 into the power plant 10 under the direction of conventional power plant controls 50 in an attempt to limit oxygen content in the power plant 10 to relatively low levels.

In order to determine the amount of hydrazine to be introduced into the power plant 10, traditionally a rotameter-type, gas flowmeter 33 is positioned in the exhaust system 36. These rotameters are not fully effective, however, beecause they only measure total exhaust, not the air or the composition of gases in the air inleakage. Most particularly, rotameters are incapable of measuring the oxygen content in air inleakage, and yet it is oxygen which actually causes most of the corrosion. In addition, a rotameter is subject to sticking as a result of oil and dirt accumulation therein. Further, rotameters require considerable maintenance and generally cannot be read remotely. Finally, in nuclear or fossil power plants, moisture is apt to be present in the exhaust system 36 to some extent because the condensors 24 are not capable of removing all the moisture therefrom. This remaining moisture is a major deterrent to positioning conventional sensors in the exhaust system 36 to monitor gas flow rates. For example, rotameters 33 fill up with moisture and become inoperable. Accordingly, it would become a problem to remove all of the water.

As a result of the above-discussed inadequacies of the prior art, corrosion continues because introduction of an oxygen scavenger into the power plant 10 is, at best, inexact, inefficient and costly. Accordingly, a method and device is lacking in the prior art which is capable of the most efficient and most accurate monitoring of air inleakage and the oxygen content therein in a nuclear or fossil power plant, and which provides a reliable, feedback system allowing control of the air inleakage and oxygen content detected.

SUMMARY OF THE INVENTION

Accordingly, it is an object of the present invention to provide a gas monitoring method and device capable of continuously and effectively monitoring air inleakage and the oxygen content thereof in a nuclear or fossil power plant.

It is another object of the present invention to provide a gas monitoring method and device which is an integral part of the exhaust system of a condenser and of the power plant controls.

It is another object of the present invention to provide a gas monitoring method and device having remote readout and enunciator capabilities.

It is another object of the present invention to provide a gas monitoring method and device capable of producing a signal indicative of the "true" air inleakage rate, together with or exclusive of the oxygen content thereof.

It is another object of the present invention to provide a gas monitoring method and device capable of producing a signal indicative of the "true" air inleakage rate and the rate at which oxygen scavenge reactions are occurring, if any, within the steam system.

It is another object of the present invention to provide a gas monitoring method and device capable of efficiently monitoring a gaseous environment having water vapor therein.

Finally, it is an object of the present invention to provide a gas monitoring method and device capable of automatically controlling the feed rate of hydrazine into the power plant based on the signals produced indicative of the air inleakage rate and oxygen content thereof detected.

To achieve the foregoing and other objects of the present invention and in accordance with the purposes of the invention, there are provided the following method and device for monitoring gas in a steam system.

The method includes the steps of: (1) monitoring air flowing in the exhaust system of a condenser; (2) determining the total gas flow rate and the oxygen content thereof; (3) injecting a pulse of oxygen into the exhaust system and measuring the transit time to the monitoring location; (4) based on this data, determining air inleakage rates, independent of or along with the oxygen content thereof; (5) comparing the air inleakage rate and the oxygen content thereof with predetermined, allowable corresponding rates; and (6), if the monitored rates are increasing relative to the predetermined, allowable rates, locating and eliminating the air inleakage and introducing more of an oxygen scavenger to control the oxygen content or, if the monitored rates are decreasing relative to the predetermined, allowable rates, introducing less of an oxygen scavenger.

The device includes a conventional, high temperature, solid oxygen, electrolyte cell sensor of the in situ, probe-type, or of the sampling-type, positioned to monitor the total gas flow and oxygen content thereof in the exhaust system. In addition, an oxygen pulse injector is located upstream of the oxygen sensor for introducing a single or repetitive pulse of oxygen into the exhaust system. The transit time of the oxygen over the distance from the point of injection to the location of the oxygen sensor is then measured by a timing device and recorder. Since both the total gas flow rate and the oxygen content thereof can be measured by the oxygen sensor, air inleakage rates, independent of or along with the oxygen content in the air inleakage, can also be measured. The feedback from these latter rates can then be used to control the amount of air inleakage by isolating and eliminating its source and to control the oxygen content in the power plant by increasing or decreasing oxygen scavenger introduction, as appropriate.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
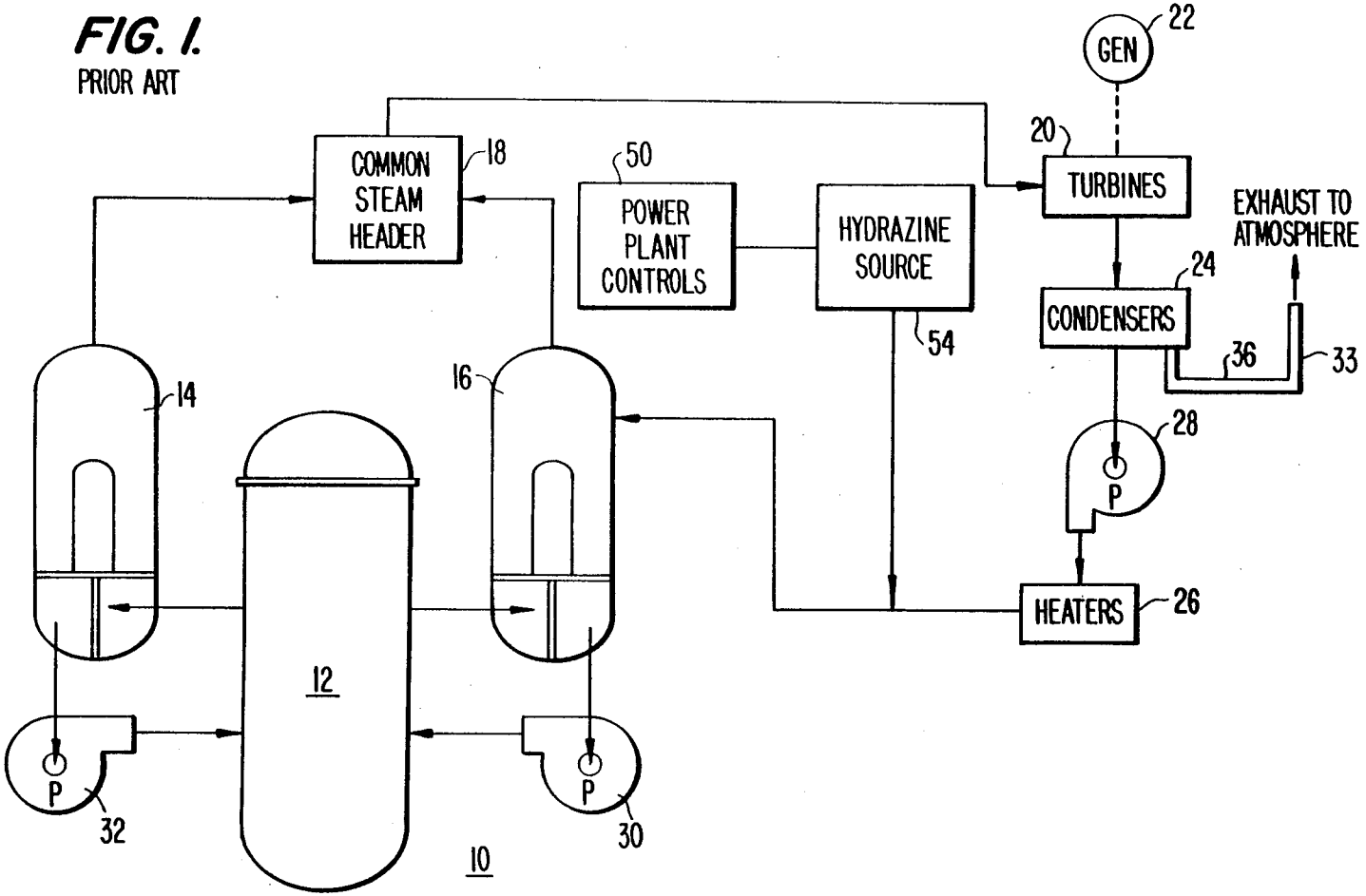
FIG. 1. PRIOR ART
FIG. 1 is a simplified, schematic view of a conventional nuclear or fossil power plant.
Figure 2:
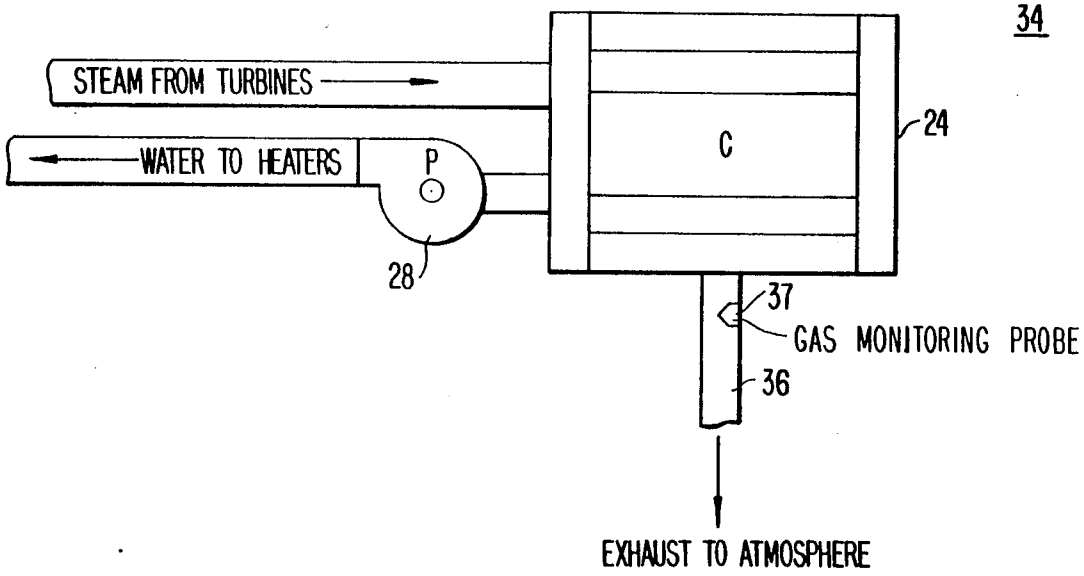
FIG. 2 is a general schematic view of the condenser assembly of the power plant according to the present invention.

FIG. 2 is a general schematic view of the condenser assembly 34 of a nuclear or fossil power plant 10 according to the present invention. As can be seen, steam moves from the turbines 20 to the condenser 24. For the purpose of describing the present invention, one condenser 24 is shown and will be described, although more than one condenser 24 may be included in the condenser assembly 34.

The condenser 24, which is under vacuum conditions, is where cooling water condenses the steam to water. The water condensate is removed from the condenser 24 via the condensate pump 28 and is returned to the heaters 26 and steam generators 14 and 16 to begin the cycle over again.

As mentioned above, when the steam is condensed into water, stable gaseous impurities remain in the condenser 24. These impurities are continuously removed from the condensers 24 via the exhaust system 36.

Generally, the present invention is directed to employing a gas monitoring means 37 relative to the exhaust system 36 of the condenser 24 to monitor air inleakage and oxygen content of the power plant 10. Using the data obtained, the amount of air inleakage and oxygen in the power plant 10 can be determined and more efficiently regulated than has been possible with the prior art methods and devices. In addition, the gas monitoring means 37 of the present invention exhibits relative insensitivity to moisture or water vapor. Accordingly, a major disadvantage of conventional sensors, e.g., a rotameter, of being relatively inoperable in the presence of moisture or water vapor, is also overcome by the present invention.

Figure 3:
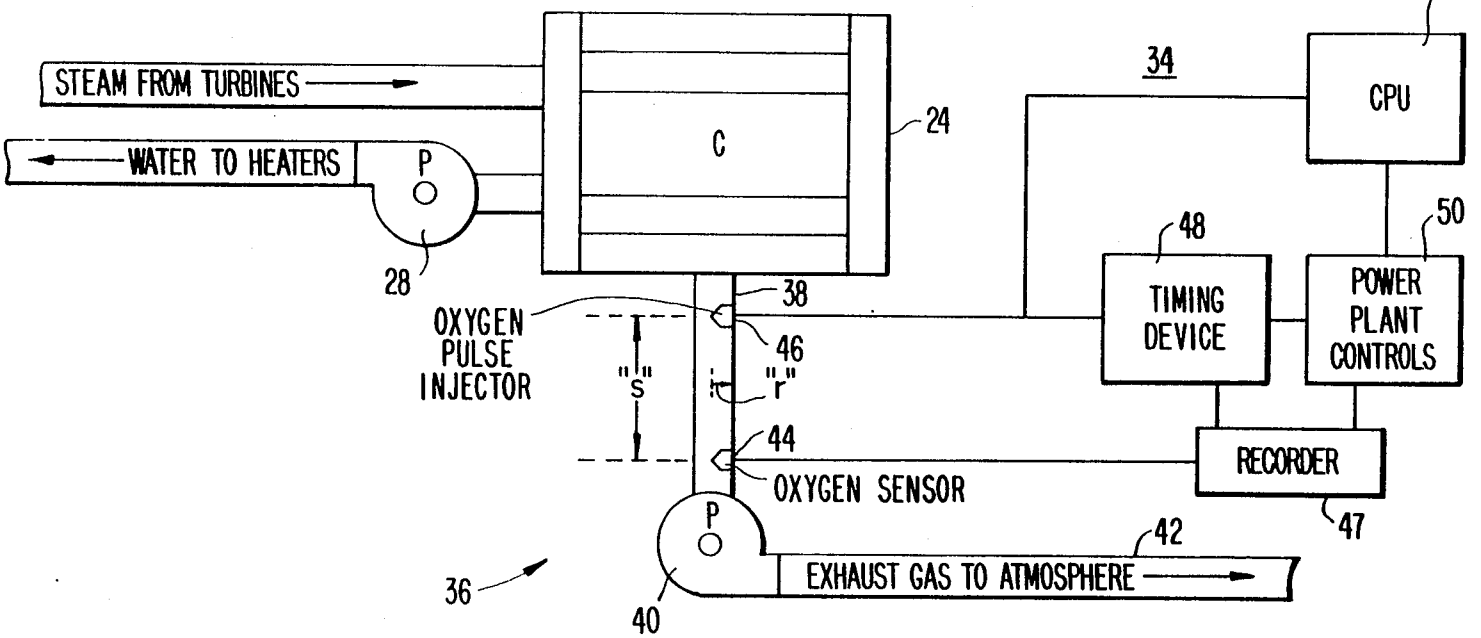
FIG. 3 is a schematic view of the condenser assembly, including exhaust system, of the power plant according to the preferred embodiment of the present invention.

In one embodiment of the present invention, as shown in FIG. 3, the exhaust system 36 includes: a first set of piping, i.e., condenser exhaust piping 38; a condenser exhaust pump 40; and a second set of piping, i.e., a vent line 42 exhausting to the atmosphere. In this preferred embodiment, a conventional, in situ, probe-type, oxygen sensor 44 is positioned within the condenser exhaust piping 38. An example of this type of sensor 44 is commercially available from Westinghouse Corporation of Pittsburgh, PA., and is known as the "Westinghouse Model 132 Mini-Probe Oxygen Analyzer".

During operation the air in the condenser exhaust piping 38 is exposed to a disc in the oxygen sensor 44. As a result, the oxygen sensor 44 continuously reads out the total air flow rate and the oxygen content thereof via a recorder 47 connected thereto. Such an oxygen sensor 44 is disclosed in U.S. Pat. No. 3,928,161 (and the related U.S. Pat. Nos. 3,400,054 and 3,546,086 discussed therein) and in co-pending U.S. Ser. No. 613,832, now U.S. Pat. No. 4,537,661, entitled "A Technique for Monitoring the Oxidation/Reduction Potential Characteristics of a Steam Environment," which are assigned to the assignee of the present application and which are expressly incorporated by reference herein.

Figure 4:
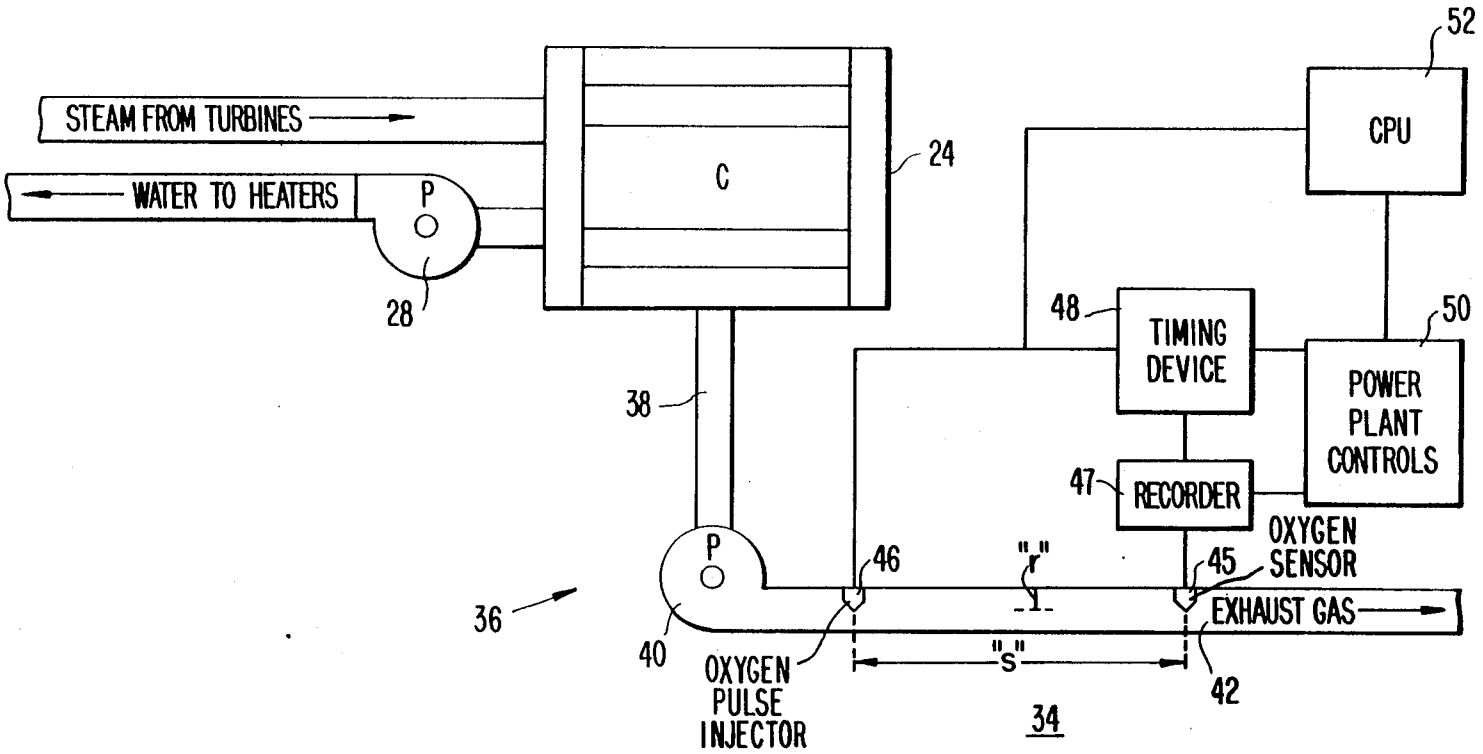
FIG. 4 is a schematic view of the condenser assembly, including exhaust system, of the power plant according to an alternate embodiment of the present invention.

In the alternate embodiment shown in FIG. 4, the exhaust system 36 is the same as in the embodiment shown in FIG. 3. In contrast, however, a conventional, sampling-type, oxygen sensor 45 is employed relative to the vent line 42. An example of this type of sensor 45 is commercially available from Westinghouse Corporation of Pittsburgh, PA. and is known as the "Westinghouse Model 209 Oxygen Monitor".

The oxygen sensor 45 includes a ceramic tube coated with platinum. During operation, the air flowing in the vent line 42 is caused to flow through the ceramic tube. As a result, the oxygen sensor 45, like the oxygen sensor 44, continuously reads out the total air flow rate and the oxygen content thereof via a recorder 47 connected thereto.

More particularly, both oxygen sensors 44 and 45 are high-temperature (i.e., 850° C.), solid-oxygen, electrolyte, cell sensors of the type:

Air, $Pt/Z_rO_2$—CaO/Pt, Sample of Exhaust Atmosphere

As described in the above U.S. Patents incorporated herein, such sensors respond to a difference in oxygen pressure between that of a known "oxygen reference" present at a first electrode in the oxygen sensor 44 or 45 and that of the unknown "environment of interest" present at a second electrode thereof by generating an EMF signal which can be remotely monitored at the recorder 47 and the power plant controls 50 connected thereto and interpreted as a measurement of the oxygen content of the environment of interest. According to the present invention, the "environment of interest" corresponds to the air flowing in the exhaust system 36 which is conducted through the oxygen sensor 44 or 45.

The E.M.F. (voltage) of the above-described cell is represented by the NERNST equation (1) below:

$$E.M.F. = \frac{RT}{NF} \ln \frac{Po_2(II)}{Po_2(I)}, \quad (1)$$

where "R" is the gas constant; "T" is the absolute temperature of the cell in °K.; "F" is the Faraday Constant; "N" is the number of electrons transferred in the electrode reaction $O_2+4e \rightleftarrows 2O^{=}$; $Po_2(II)$ is the partial pressure of oxygen in the reference gas; and $Po_2(I)$ is the oxygen partial pressure of the sample to be measured taken from the exhaust system 36.

For such a cell operating at 850° C. and a partial pressure of oxygen in the reference gas at one atmosphere (atm), i.e., $Po_2(II)=0.21$ atm, equation (1) reduces to:

$$E.M.F.\ (850°\ C.) = .056 \log \frac{0.21\ atm}{Po_2(I)} \quad (2)$$

When the oxygen partial pressure of the sample ($Po_2(I)$) is also 0.021 atm, the log term reduces to one and the cell voltage is 0.056 volts.

When the oxygen partial pressure of the sample is air at one atm, the cell voltage is zero.

Accordingly, equation (2) above permits the calculation and measurement of the partial pressure of oxygen in the exhaust system 36 from the voltage reading. That is, since the exhaust system normally operates at one atm, departures in the oxygen concentration from that of air (21%) can easily be noted.

In summary of the above-described aspects of the present invention, a conventional in situ-type oxygen sensor 44 or a sampling-type oxygen sensor 45 is uniquely positioned for monitoring the gases in the exhaust system 36 of a condenser 24 in a steam system 10. In operation, either of these sensors 44 or 45 is capable of monitoring the total gas flow rate and oxygen content thereof in the exhaust system 36.

The present invention also contemplates the use of an oxygen pulse injector 46 and a timing device 48 in combination with the recorder 47 and the oxygen sensors 44 and 45. This combination is capable of yielding "true" or actual air inleakage rates, in addition to or exclusive of the oxygen content of the air inleakage, and of producing electrical signals indicative thereof.

More particularly, as shown in FIGS. 3 and 4, an electrically controlled and timed oxygen pulse injector 46 is located upstream of the oxygen sensors 44 and 45 to introduce a pulse of oxygen into the exhaust system 36. The pulse may be a single pulse or it may be a repetitive pulse on a timed schedule, e.g., once a minute or hour. Using the timing device 48, which is operatively connected to the oxygen pulse injector 46 and the recorder 47, the transit time of the travelling oxygen over a distance "s" from the oxygen pulse injector 46 to the oxygen sensors 44 or 45, can be measured and recorded.

Finally, a central processing unit 52, is connected between the oxygen pulse injector 46 and the power plant controls 50 to receive each injection measurement and produce an average of all injection measurements over a period of time. This average can then be used to monitor power plant operational consistency or fault diagnostics, as described below.

Regarding the measurement of the injected oxygen, the volume flow "F" of gas moving through the exhaust system 36 per unit of time "t" can be determined knowing the velocity "v" of the gas (ft/min), the cross-sectional area of the pipe used in the exhaust system 36, and the pressure (atm).

For example, the volume flow "F" in the part of the exhaust system 36 after the pump 40 at one atm is represented as:

$$F(cfm) = v(ft/min) \times 3.14 \times r^2 \quad (3)$$

for a round pipe of radius "r", containing a gas moving at a velocity "v".

The velocity of the gas in the exhaust system 36 is determined by measurement of the time "t" of movement of the injected oxygen eminating from the oxygen pulse injector 46 over the distance "s" from the point of injection to the oxygen sensor 44 or 45 location downstream, according to the following formula:

$$v\ (ft/min) = \frac{s\ (ft)}{t\ (min)} \quad (4)$$

Figure 5:
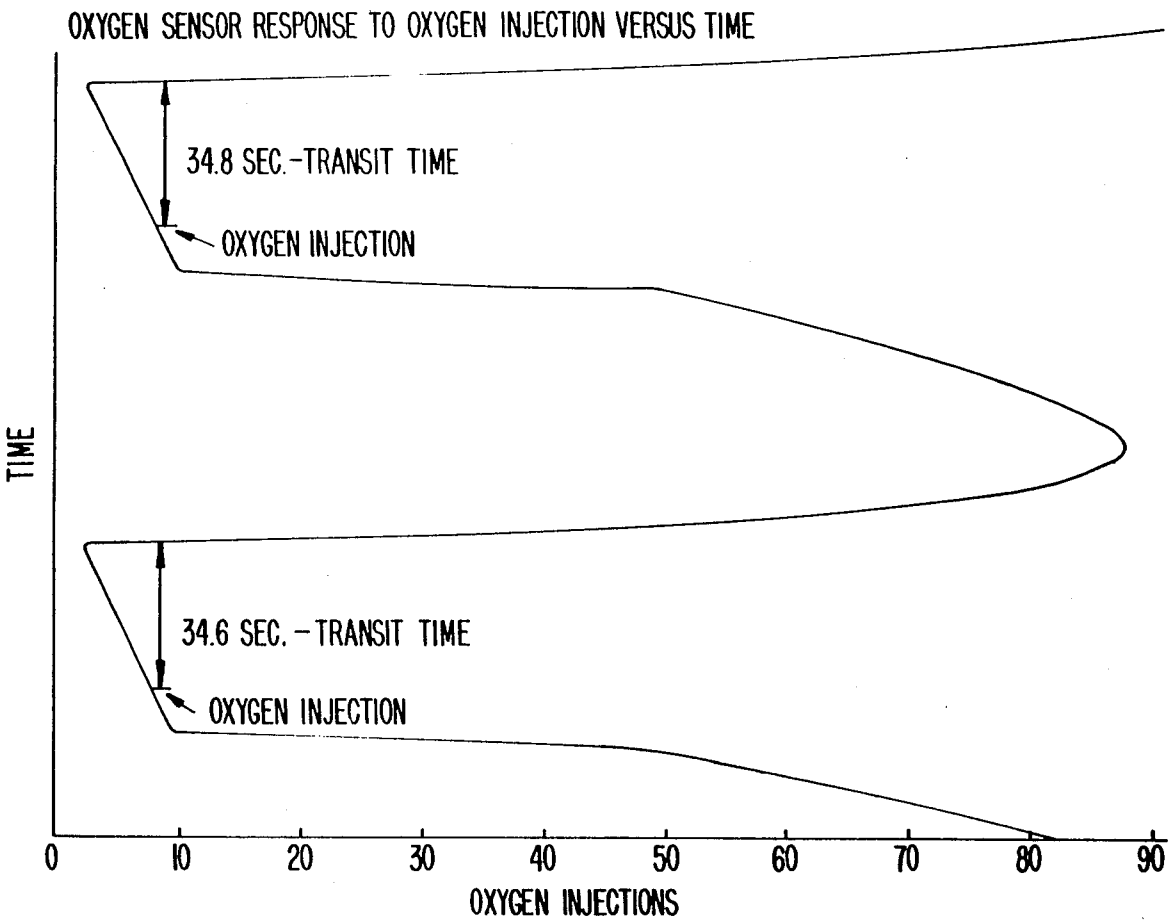
FIG. 5 is a graphic view of a recorder response to two exhaust injections during operation of the present invention.

FIG. 5 is a graphic view of the response of the timing device 48 and recorder 47 to two pulses of oxygen from the oxygen pulse injector 46. The graph illustrates that an electrical connection between the oxygen pulse injector 46 and the timing device 48 provides a mark in the recorder trace signifying the time of injection. The first indication of the oxygen arriving at the oxygen sensors 44 or 45 is also recorded by the timing device 48 and recorder 47 and used in the above gas transit time measurement, namely 34.6 and 34.8 seconds based on the exhaust velocity v in the exhaust system 36.

As suggested above, the oxygen content of the air in the exhaust system 36 usually varies from 0% to 21%. However, in the event of air inleakage in the form of air-saturated water, the oxygen content of the air in the exhaust system 36 might exceed 21%. The demonstrated useful measurement range of the oxygen sensors 44 and 45 according to the present invention is $1\times10^{-4}$ to $1\times10^{3}$ Torr. This range permits the use of the sensors 44 or 45 for the continuous measurement of the partial pressure of oxygen in the exhaust system 36. Since the exhaust system 36 operates at a nominal pressure of one atm, the volume flow of only oxygen in the exhaust system 36 can be calculated. This measurement identifies the quantity of oxygen scavenged in the power plant 10 and makes possible the calculation of a true air inleakage rate, independent of oxygen chemical reactions within the power plant 10.

In other words, the oxygen partial pressure in the exhaust system 36 at one atm may vary in a power plant 10 from 0.21 atm to 0 atm due to oxygen removal reactions occurring therein. This oxygen depletion reduces the air volume flow rates measured in the exhaust system 36 according to the following equation (5), which is correct only if the gas in the exhaust system 36 contains 0.21 atm of oxygen. That is, utilizing the oxygen partial pressure measurement in the exhaust system 36 of equations (1) and (2), the corrected gas volume flow rate "F" is given by equation (5):

$$F\left(\frac{\text{ft}^3}{\text{min}}\right) = v\left(\frac{\text{ft}}{\text{min}}\right) \times 3.14 \times r^2\text{ft}.(1.21 - Po_2(I)) \quad (5)$$

where "$Po_2(I)$" is the measured oxygen partial pressure in the exhaust system 36.

If the measured oxygen partial pressure ($Po_2(I)$) is very small, indicating all air inleakage oxygen has reacted within the power plant 10, then the corrected flow rate (F') will be 21% greater than the measured flow rate. On the other hand, if the measured oxygen partial pressure ($Po_2(I)$) is 0.21 atm, the measured (F) and corrected flow rates (F') will be equal.

In summary of the above, the present invention is capable of monitoring: (1) the total gas flow rate in the exhaust system 36 and the oxygen content thereof; (2) the "true" air inleakage rate in the power plant 10, together with or exclusive of the oxygen content thereof; and (3) the "true" air inleakage rate and the rate at which oxygen scavenge reactions are occurring in the power plant 10. In addition, each rate monitored can be associated with an electrical signal which is generated for use in power plant operation.

That is, the present invention contemplates use of the device and method described above as an integral part of power plant controls 50, i.e., the present invention can be used as a part of a feedback control system with an enunciator (not shown) to create an alarm set off by air inleakage excesses.

The present invention can also be used to maintain a constant or variable ratio of oxygen scavenger feed, e.g., hydrazine, relative to the air inleakage rate. More particularly, if a high oxygen content is detected, the enunciator will signal and the internal hydrazine level will be increased via the power plant controls 50. On the other hand, if the oxygen content decreases, the amount of hydrazine introduced can be decreased.

Accordingly, the present invention automatically maintains the proper amount of oxygen scavenger to be introduced into the power plant by monitoring the oxygen content therein. Thus, the automatic feedback system of the present invention provides increased control over, e.g., hydrazine introduction and makes its use more efficient and less costly than was capable with the prior art.

Further, the signals produced by the present invention and its ability for monitoring oxygen exhaust flow rates, when coupled with "fault" diagnostic capability of the central processing unit 52, makes possible accurate air inleakage fault diagnostics which are unavailable with the prior art methods and devices. "Fault" in this case is defined as an error or inadequacy of the system, or something that makes the system operate outside the normal range. For example, an increasing level of air inleakage would be a "fault". The actual cause or source of the fault can be established using fault diagnostics.

More particularly, the central processing unit 52 may take the reading of the oxygen sensors 44 or 45 in combination with the reading of several other types of power plant fault diagnostic sensors. If fault is detected, e.g., air inleakage is detected as increasing, this fault is going to affect the reading of other types of sensors in the power plant. Accordingly, the central processing unit 52 takes all of the available sensory information and, using predetermined, conventional equations regarding optimum operation set in its memory, analyzes all the parameters for operational consistency.

Thus, the present invention is capable of monitoring power plant operational consistency and following an increasing or decreasing trend in the power plant oxygen content. The trend data is then used to tell whether the fault is or is not improving and where the fault is occurring. The fault can then preferably be corrected at a scheduled, rather than at an emergency, shut down.

As seen from the above discussion, the present invention is an improvement over the conventional gas monitoring methods and devices because it provides: continuous and accurate measurements of both the total gas and oxygen flow rates in a condenser exhausting to the atmosphere; a gas monitoring method and device which is an integral part of the exhaust system of a condenser, but which has remote readout and enunciator capabilities; a gas monitoring means, including the combination of an oxygen pulse injector; a high temperature, oxygen sensor of the sampling or in-situ type, and an oxygen timing device and recorder; signals indicative of the air inleakage and/or oxygen content thereof for use in activation of enunciators and other automatic power plant controls, fault diagnostics and automatic control of the feed rate of oxygen scavengers into the power plant.

The foregoing is considered as illustrative only of the principles of the invention. For example, although the present invention has been described in particular relation to use with a nuclear or fossil power plant, the present invention can be used in any type of steam system employing a condenser exhausting to the atmosphere, e.g., a hot water boiler heating system for a building.

Further, since numerous modifications and changes will readily occur to those skilled in the art, it is not desired to limit the invention to the exact construction and operation shown and described. Accordingly, all suitable modifications and equivalents may be resorted to, falling within the scope of the invention and the appended claims and their equivalents.

I claim as my invention:

1. A method for monitoring gas flowing within the exhaust system of a condenser in a steam system, comprising the steps of:

(a) monitoring the gas flowing in the exhaust system;

(b) determining the total gas flow rate and oxygen content of the gas flowing in the exhaust system;

(c) introducing a pulse of oxygen in the exhaust system upstream from the gas monitoring location; and (d) determining the air inleakage rate in the steam system and the oxygen content of the air inleakage based on the transit time of the oxygen pulse from the pulse introduction location to the gas monitoring location, the total gas flow rate and the oxygen content in the exhaust system.

2. The method as recited in claim 1, further comprising the steps of:

(e) comparing the actual, monitored air inleakage rate and the oxygen content thereof with predetermined, allowable corresponding rates for the steam system; and (f) if the actual, monitored rates are increasing relative to the predetermined, allowable rates, isolating and eliminating the air inleakage and introducing more of an oxygen scavenger to control the oxygen content in the steam system or, if the actual, monitored rates are decreasing relative to the predetermined, allowable rates, introducing less of an oxygen scavenger.

3. A device for monitoring gas flowing within the exhaust system of a condenser in a steam system, comprising:

(a) means positioned relative to the exhaust system for monitoring the total gas flow rate therein and the oxygen content thereof;

(b) means located in the exhaust system upstream of the gas monitoring means for injecting a pulse of oxygen therein; and (c) means connected between the oxygen pulse injecting means and the gas monitoring means for recording the transit time of the oxygen from the oxygen pulse injecting means to the gas monitoring means and for determining the actual air inleakage rate in the steam system and the oxygen content thereof.

4. The device as recited in claim 3, further comprising:

(d) means for comparing the actual, monitored air inleakage rate and oxygen content thereof with predetermined, allowable corresponding rates; and (e) means for introducing an oxygen scavenger, wherein, if the actual, monitored rates are increasing relaive to the predetermined, allowable rates, more oxygen scavenger is introduced to control the oxygen content in the steam system, and wherein, if the actual, monitored rates are decreasing relative to the predetermined, allowable rates, less oxygen scavenger is introduced.

5. The device as recited in claim 4, wherein the gas monitoring means is an in situ, probe-type oxygen sensor.

6. The device as recited in claim 4, wherein the gas monitoring means is a sampling-type oxygen sensor.

7. The device as recited in claim 4, wherein the oxygen scavenger is hydrazine.

* * * * *